US005893222A

United States Patent [19]

Donnelly

[11] Patent Number: 5,893,222

[45] Date of Patent: Apr. 13, 1999

[54] HEAT MOLDABLE BOOT LINER

[76] Inventor: Peter Donnelly, #186-916 West Broadway, Vancouver, British Columbia, Canada, V5Z 1K7

[21] Appl. No.: 09/028,921

[22] Filed: Feb. 24, 1998

[30] Foreign Application Priority Data

Feb. 28, 1997 [CA] Canada ..... 2198787

[51] Int. Cl.[6] ..... A43B 19/00; A43B 5/04; A43B 23/07

[52] U.S. Cl. ..... 36/117.6; 36/10; 36/55

[58] Field of Search ..... 36/117.6, 10, 55, 36/54

[56] References Cited

U.S. PATENT DOCUMENTS

| | | | |
|---|---|---|---|
| 4,451,995 | 6/1984 | Antonious . | |
| 4,790,082 | 12/1988 | Pozzebon . | |
| 5,067,257 | 11/1991 | Coomer . | |
| 5,289,645 | 3/1994 | Marega et al. . | |
| 5,544,433 | 8/1996 | Borsoi et al. . | |
| 5,669,160 | 9/1997 | Pozzebon . | |
| 5,673,448 | 10/1997 | Lang et al. | 12/142 R |
| 5,802,742 | 9/1998 | Baude et al. . | |

FOREIGN PATENT DOCUMENTS

| | | |
|---|---|---|
| 73990 | 3/1983 | European Pat. Off. . |
| 2230155 | 12/1974 | France . |
| 654467 | 2/1986 | Switzerland . |

*Primary Examiner*—Ted Kavanaugh

[57] ABSTRACT

A heat moldable boot liner has an upper portion extending upwardly from a foot portion, which has a pair of flaps extending along the foot portion, the flaps being adjustable to bring one of the flaps into overlapping relationship relative to the other of the flaps over the wearer's foot. A tongue extends upwardly from the other one of the flaps within the upper portion of said liner, which has another pair of flaps intended to be overlapped over the tongue at the lower portion of the wearer's leg. The foot portion includes a heel portion shaped to fit snugly the user's heel. The present liner can be heat-molded in a single-stage molding operation.

4 Claims, 4 Drawing Sheets

HEAT MOLDABLE BOOT LINER

BACKGROUND OF THE INVENTION

1. Field of the Invention

The present invention relates to a heat moldable boot liner for use, for example, with a ski boot.

2. Description of the Related Art

Conventionally, moldable ski boot liners are made of a heat moldable material comprising a heat moldable foam interfaced between outer layers of felt fabric, and such heat moldable materials are readily commercially available.

In U.S. Pat. No. 5,673,448, issued Oct. 7, 1997, to Herbert Lang et al., there is disclosed a liner for a sports boot shell and a method of making a custom fitted liner for a sports boot shell which employ a single piece of thermoplastic foam material for the liner. More particularly, a blank made of the thermoplastic foam material is welded or stitched to connect together different portions of the edge of the blank so as to form an unfitted liner having a seam extending from its heel along its underside, and up and over the top of a foot portion of the liner to a gap which extends from a point situated centrally on the wearer's forefoot behind the wearer's toes and between the forward portion of the wearer's arch and the region above the ball of the wearer's foot. From this point, the gap extends upwardly between a pair of flaps or wings to a cuff at the top of the liner.

In use, the unfitted liner is heated in an oven and placed on the wearer's foot, the toes of which are padded to prevent the liner from subsequently holding the wearer's toes immobile. The wings are then wrapped around the wearer's lower leg, with one wing overlapped by the other, and a short nylon stocking is rolled over the liner, after which the wearer's foot with the liner on it is placed in a boot.

However, it has been found in practice that such a liner does not operate satisfactorily because the portions of the liner adjacent the gap, including the wings, tend to become adversely distorted as the wings are wrapped around the wearer's lower leg and as the foot and liner are inserted into the boot. Because the seam extends along the underside of the liner and because the underside of the liner is formed of deformable foam material, the shape of the liner is unstable as the liner is forced into its boot shell. Also, the foam molds itself into the soft parts of the underside of the wearer's foot during the molding operation, which causes pain and discomfort during subsequent use of the molded liner. It was also found that the heel portion of this prior liner tended to become dislocated during the molding operation, thus not only causing distortion of the lower portion of the liner but also causing dislocation of the cuff or top of the liner at the back of the wearer's leg, where the liner is required to be correctly positioned to protect the leg against the cuff or top of the boot shell. In addition, because this prior liner has only two wings, it is difficult to insert the wearer's foot with the liner after the molding of the liner has been completed and the liner material has hardened.

BRIEF SUMMARY OF THE INVENTION

It is accordingly an object of the present invention to provide a novel and improved boot liner which facilitates improved molding of the liner to the user's foot.

According to the present invention, there is provided a heat moldable boot liner which comprises a foot portion, an upper portion extending upwardly from the foot portion and including first and second flaps which can be wrapped over the wearer's foot and a tongue extending upwardly from the second flap. The upper portion has third and fourth flaps which can be wrapped over the tongue and the front of a lower portion of the wearer's leg.

When the present boot liner is in use, it is firstly heated to render the liner pliable and is then fitted in an unmolded state to the user's foot. The flaps are then adjusted into their overlapping relationships, with the tongue between the wearer's lower leg portion and the third and fourth flaps. The first and second flaps are preferably secured together, for example by means of a hook-and-loop fastener, so that the foot portion of the boot is snugly adapted to fit the user's foot. The liner and the wearer's foot in the liner are then inserted into a boot shell so as to mold the liner to the user's foot in a one-stage operation.

BRIEF DESCRIPTION OF THE DRAWINGS

The invention will be more readily understood from the following description of a preferred embodiment thereof given, by way of example, with reference to the accompanying drawings, in which.

DESCRIPTION OF THE PREFERRED EMBODIMENT

Figure 1:
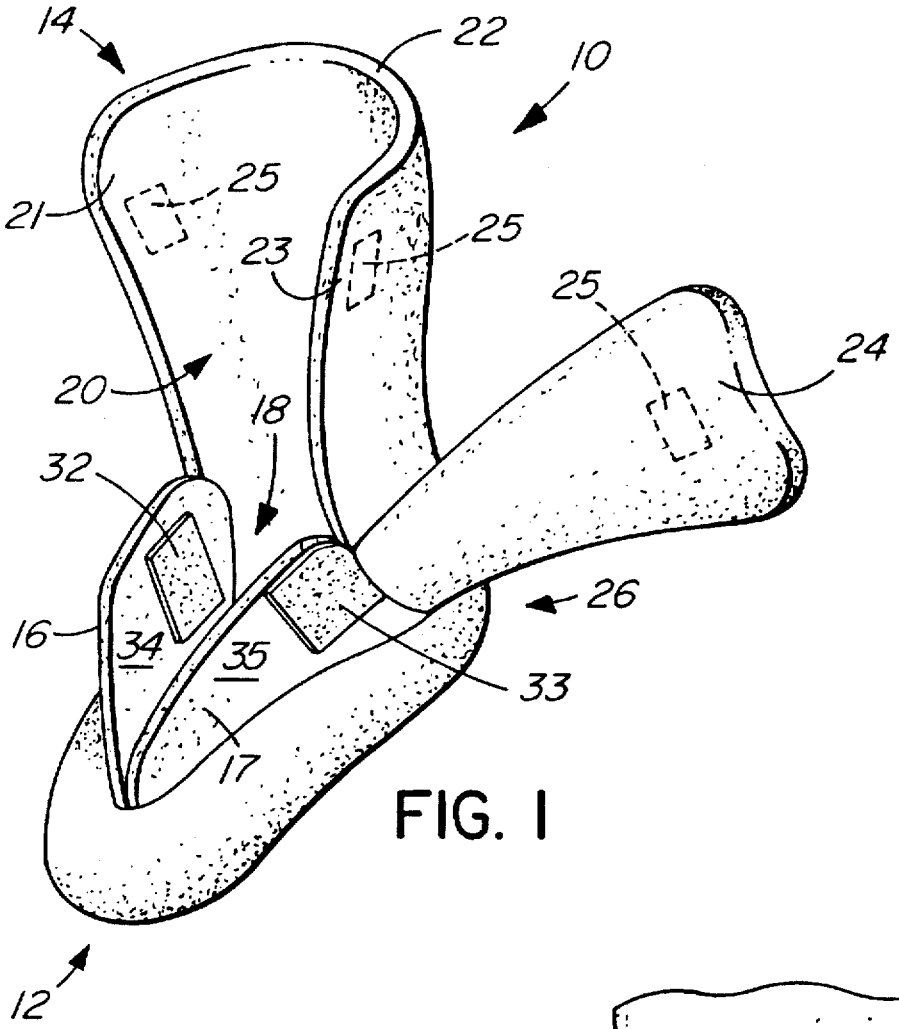
FIG. 1 shows a view in perspective of a boot liner according to the present invention in an opened condition.

The boot liner illustrated in the accompanying drawings and indicated generally by reference numeral 10 is made of commercially available heat moldable boot liner material, such as that described above, and comprises a foot portion indicated generally by reference numeral 12, and an upper portion indicated generally by reference numeral 14.

The foot portion 12 is formed, at its top, with first and second flaps 16 and 17 which define therebetween a gap, indicated generally by reference numeral 18, which extends along the top of the foot portion 12 to the upper portion 14 of the liner and, more particularly, to a gap, indicated generally by reference numeral 20, which extends upwardly from the foot portion 12 to a top edge 22 of the upper portion 14 between third and fourth flaps 21 and 23 forming parts of the upper portion 14.

Figure 4:
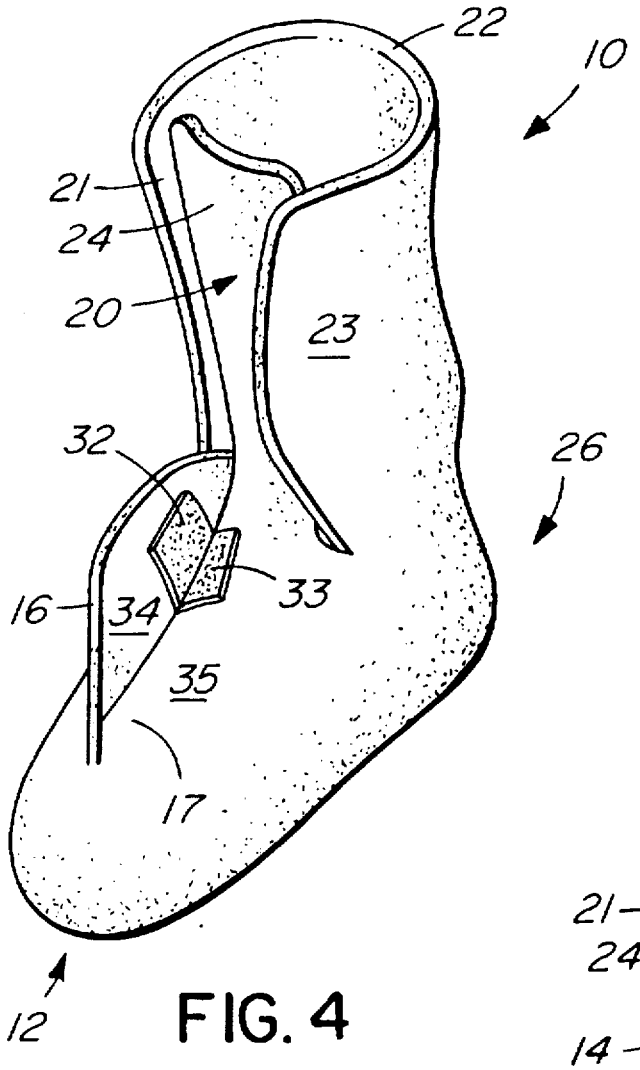
FIG. 4 shows a view in perspective of the liner of FIG. 1 during fitting of the liner onto a wearer's foot (not shown)
Figure 5:
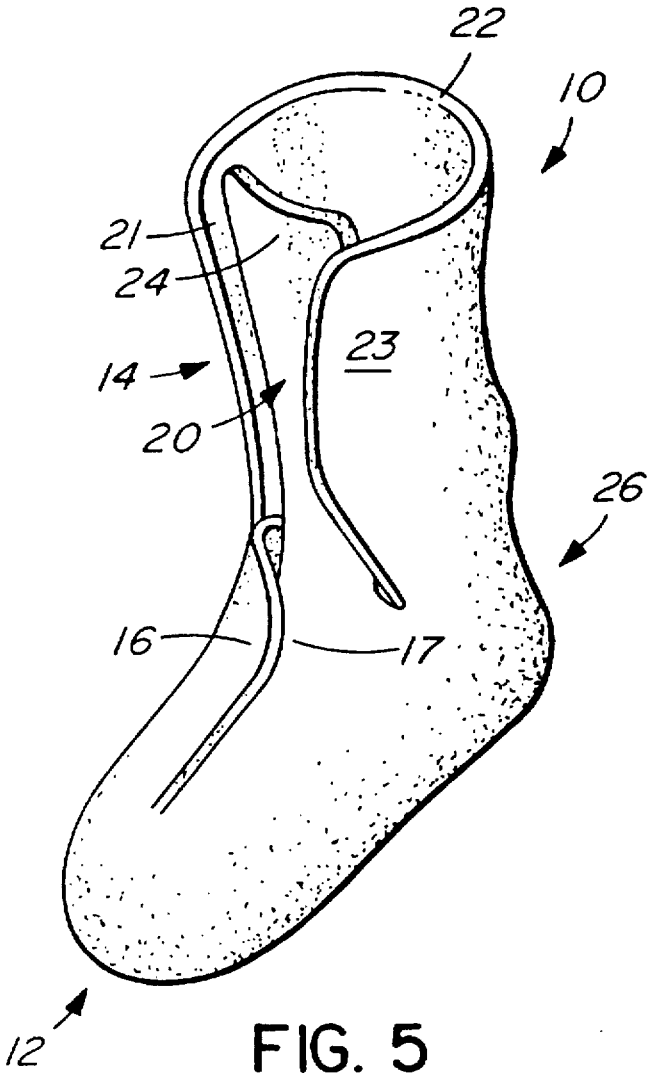
FIG. 5 shows a view in perspective of the liner of FIGS. 1 and 4 in a partially closed condition.

A tongue 24 is joined, at a lower end of the tongue 24, to the second flap 17 and is dimensioned so that, when the boot liner 10 is closed as shown in FIGS. 4 and 5, the tongue 24 extends along the front of the lower portion of the wearer's leg, with the tongue 24 extending the entire height of the upper portion 14 of the liner 10, substantially to the top edge 22 of the upper portion 14.

Figure 2:
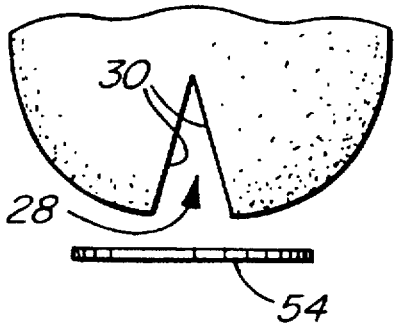
FIG. 2 shows a heel portion of the liner of FIG. 1 during the manufacture of the liner.
Figure 3:
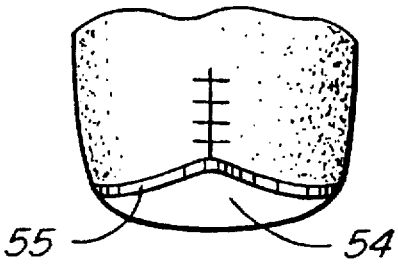
FIG. 3 shows a view of the heel portion of FIG. 2 in a finished condition.

During the manufacture of the boot liner 10 shown in FIG. 1, a heel portion, indicated generally by reference numeral 26, of the foot portion 12 is formed so as to be vertically curved, with the heel portion 26 having an externally convex shape, as shown in FIGS. 4 and 5, and, consequently, a correspondingly concave inner surface, in order to snugly fit the heel of the user. This curved shape of the heel portion 26 is produced by firstly forming a V-shaped cut-out, as indicated generally by reference numeral 28 in FIGS. 2 and 6, in the heel portion 26 and by the closing together of opposite edges 30 of the cut-out 26 and stitching these edges 30 together as illustrated in FIG. 3.

When the boot liner 10 is fitted to the user's foot, the boot liner is firstly heated to render the material of the liner pliable, in known manner, and the boot is then inserted into the liner. The flap 16 is then adjusted so that it is disposed in overlapping relationship relative to the flap 17, as shown in FIG. 4, over the wearer's foot. This enables the foot portion 12 to be snugly fitted to the user's foot. As can also be seen from FIG. 4, the tongue 24 is located within the upper portion 14 of the liner 10 during this operation.

In order to maintain the foot portion 12 in its snugly fitting relationship with the user's foot, a fastener is provided in the form of patches 32 and 33 of hook-and-loop fastener material secured to opposed faces 34 and 35 of the flaps 16 and 17, the faces 34 and 35 being brought into face-to-face relationship with one another so as to interengage the patches 32 and 33 with one another, as shown in FIG. 4.

After the flaps 16 and 17 have been thus snugly fitted in mutually overlapping relationship, as shown in FIG. 5, over the wearer's foot, with the tongue 24 extending up the front of the lower portion of the leg of the wearer, the flaps 21 and 23 are wrapped around the lower leg portion into overlapping relationship with one another and with the tongue 24.

The wearer's foot and the liner are then inserted into a boot shell to cause the still-pliable liner to be molded between the foot and the boot shell. The insertion of the foot and the liner into the boot shell may, if desired, be facilitated by covering the liner with a plastic sheet material or other low-friction material to facilitate sliding of the liner into the boot shell by reducing friction between the liner and the boot shell.

Also, if desired, the upper flaps 21 and 23 may be retained in snugly fitting overlapping relationship around the lower leg by means of a strap (not shown) extending around the upper portion 14 of the liner 10.

When the liner 10 is intended for a snowboard boot shell, as distinct from a ski boot shell, hook-and-loop fastener material patches shown in broken lines in FIG. 1 and indicated by reference numeral 25 may be used to secure the flaps 21 and 23 together and to the tongue 24.

Since the foot portion 12 can be snugly fitted to the foot of the user, as described above, and retained by the fastener patches 32 and 33, the foot portion 12 remains in position on the user's foot during insertion into the boot shell and resists being moved around the foot, and since the snugness of this fitting and the insertion into the boot shell without dislocation of the liner on the foot are facilitated by the above-described vertical curvature of the heel portion 26, it is found that the liner 10 can be heat molded in a one-stage molding operation, which substantially facilitates and abbreviates the fitting of the liner 10 to the foot of its user.

Figure 6:
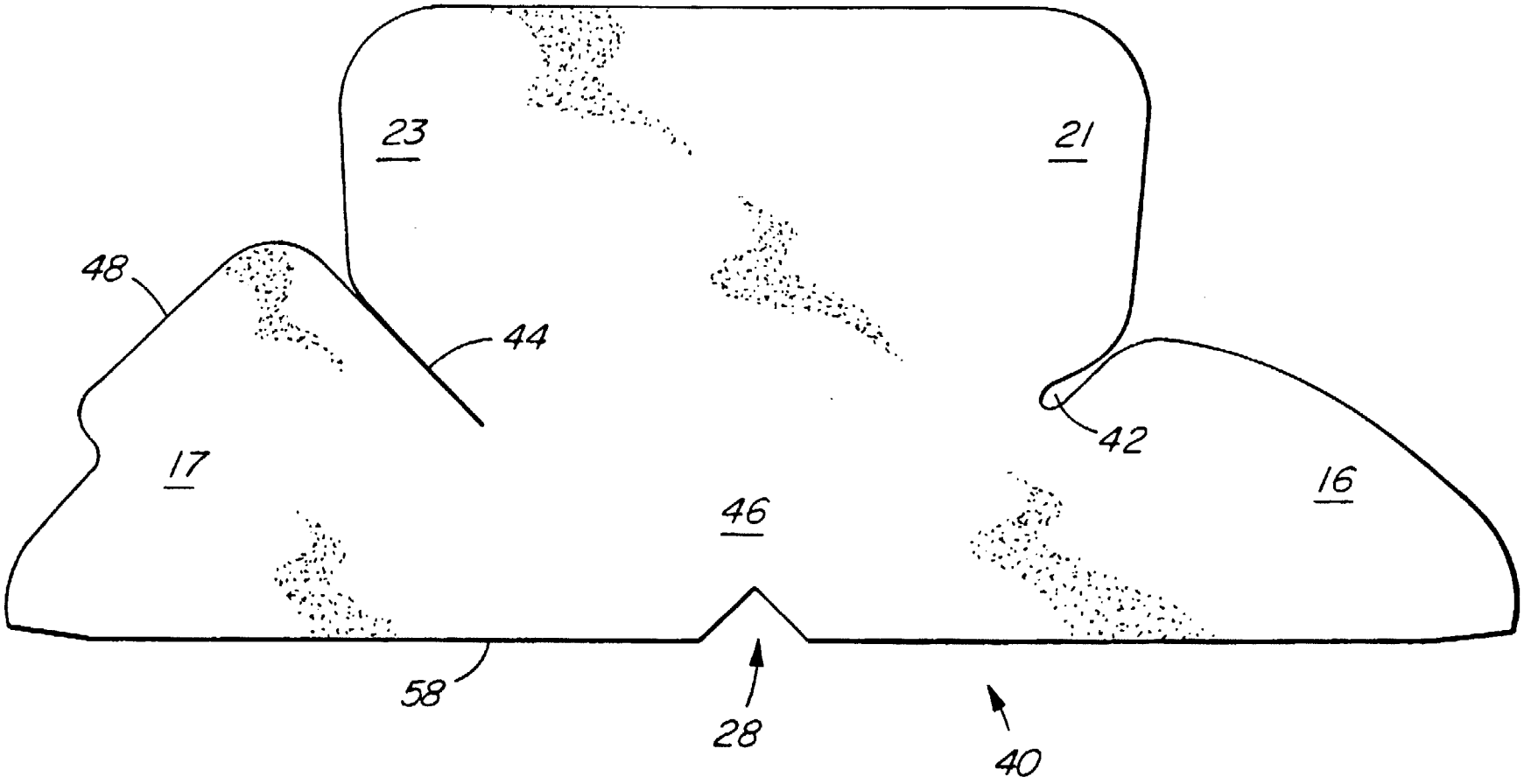
FIG. 6 shows a blank employed in the making of the boot liner of FIGS. 1 through 5.
Figure 7:
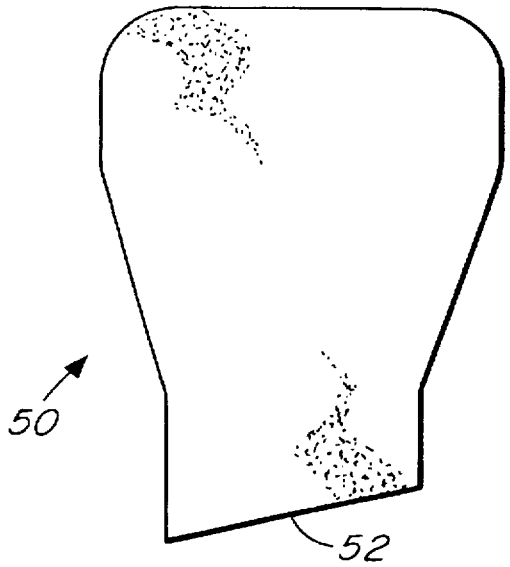
FIGS. 7 and 8 show blanks of a tongue and a sole, respectively, forming parts of the liner of FIGS. 1 through 6.

FIG. 6 shows a blank, indicated generally by reference numeral 40, of heat moldable material used to make the liner 10.

The blank 40 is formed with a gap 42 which extends between the first and third flaps 16 and 21 and another gap 44, in the form of a slit, which extends between the second and fourth flaps 17 and 23. The gaps 42 and 44, as viewed in FIG. 6, are inclined downwardly and convergently towards a heel portion 46 in which the cut-out 28 is formed. These gaps 42 and 44 enable the flaps 16, 17, 21 and 23 to be wrapped snugly around the wearer's foot and leg in such a manner as to counter-act subsequent distortion of the liner during the molding of the liner.

More particularly, the gaps 42 and 44 are sufficiently long to ensure that stresses in the flaps 16 and 17 are not transmitted to the flaps 21 and 23, and vice versa, during the fitting and molding of the liner 10.

The flap 17 is formed with a straight edge 48 and the tongue 24 is formed from a blank indicated generally by reference numeral 50 in FIG. 6, which has a corresponding straight edge 52. The tongue 24 is formed by joining the blank 50 along its edge 52 by stitching or welding to the edge 48 of the flap 17.

Figure 8:
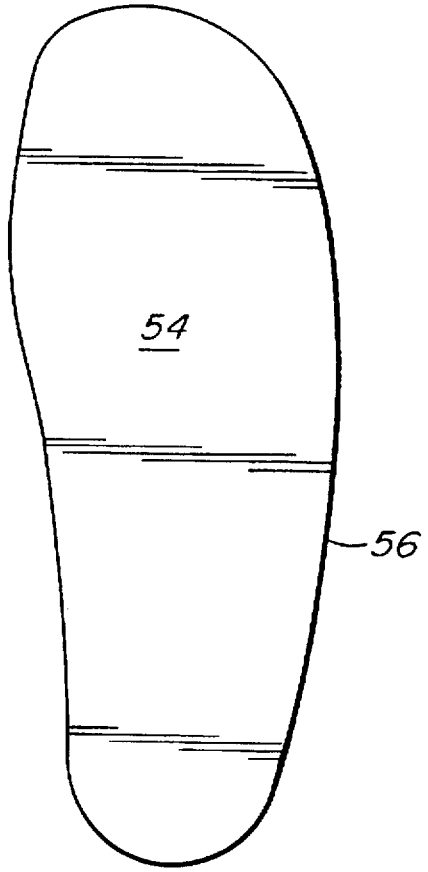
Figure 9:
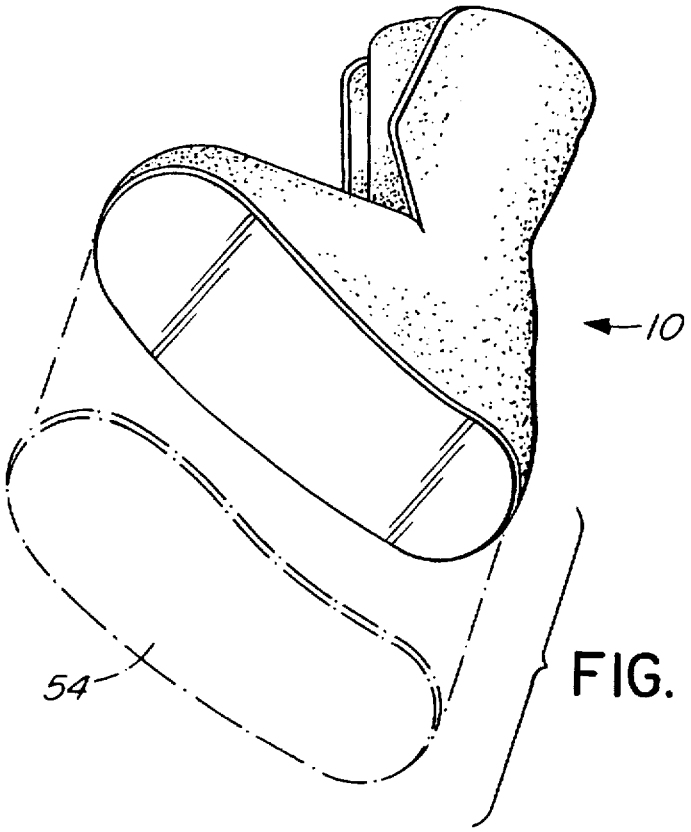
FIG. 9 shows a view in perspective of the sole of FIG. 8 being attached to the remainder of the liner.

The boot liner 10 also includes a sole 54, shown in FIG. 8, which is firstly formed separate from the blank 40 and then secured, by a joint 55 (FIG. 3) along a peripheral edge 56 (FIG. 6) of the sole 54, to a bottom edge 58 of the blank 40, also by stitching or welding.

The sole 54 is made of a material which is such that the sole 54 is not molded to the wearer's foot during the fitting and molding of the liner 10. This avoids a "mashy" feel between the foot and the sole, which is undesirable when skiing. The sole 54 also provides stability during the fitting and molding and therefore counteracts dislocation of the sole and the rest of the liner during the fitting and molding of the liner.

The sole 54 may, for example, be made of natural gum rubber or a synthetic elastomer, and may be premolded, as a foot bed, to the underside of the wearer's foot.

I claim:

1. A method of fitting a heat moldable boot liner to a wearer's foot, comprising the steps of heating said boot liner to render said liner moldable;

inserting the wearer's foot into said liner;

wrapping first and second flaps on said liner into mutually overlapping relationship over the wearer's foot;

locating a tongue extending from said second flap against the front of a lower leg portion of the wearer;

wrapping third and fourth flaps on said liner around the front of the lower leg portion of the wearer into overlapping relationship with one another and with said tongue; and inserting the liner, with the wearer's foot within, into a boot shell to mold the liner between the wearer and the boot shell.

2. A method as claimed in claim 1, which includes fastening said first and second flaps to one another in their mutually overlapping relationship.

3. A method as claimed in claim 1, which includes providing said boot liner with a seamless sole joined peripherally of said sole to said liner.

4. A method as claimed in claim 1, which includes providing said boot liner with a vertically externally conversely curved heel portion so as to snugly fit the wearer's heel.

* * * * *